US010281175B2

(12) United States Patent
Xu et al.

(10) Patent No.: US 10,281,175 B2
(45) Date of Patent: May 7, 2019

(54) REGENERATIVE REFRIGERATOR, FIRST STAGE REGENERATOR, AND SECOND STAGE REGENERATOR

(71) Applicant: Sumitomo Heavy Industries, Ltd., Tokyo (JP)

(72) Inventors: Mingyao Xu, Tokyo (JP); Tian Lei, Tokyo (JP); Akihiro Tsuchiya, Tokyo (JP); Qian Bao, Tokyo (JP)

(73) Assignee: SUMITOMO HEAVY INDUSTRIES, LTD., Tokyo (JP)

( * ) Notice: Subject to any disclaimer, the term of this patent is extended or adjusted under 35 U.S.C. 154(b) by 858 days.

(21) Appl. No.: 14/486,417

(22) Filed: Sep. 15, 2014

(65) Prior Publication Data

US 2015/0075188 A1 Mar. 19, 2015

(30) Foreign Application Priority Data

Sep. 17, 2013 (JP) ..... 2013-191537
May 2, 2014 (JP) ..... 2014-094959

(51) Int. Cl.
*F25B 9/00* (2006.01)
*F04B 37/08* (2006.01)
(Continued)

(52) U.S. Cl.
CPC ..... *F25B 9/145* (2013.01); *F25B 9/10* (2013.01); *F25B 2309/1415* (2013.01)

(58) Field of Classification Search
CPC ..... F25B 9/06; F25B 9/10; F25B 9/14; F25B 2309/023; F25B 9/00; F25B 9/145; F04B 37/08; F04B 37/085; B01D 8/00
See application file for complete search history.

(56) References Cited

U.S. PATENT DOCUMENTS 4,607,424 A * 8/1986 Johnson ..... B23P 15/26 165/4
6,065,295 A * 5/2000 Hafner ..... F04B 37/08 165/10

(Continued)

FOREIGN PATENT DOCUMENTS

CN 1343241 A 4/2002
CN 101124289 A 2/2008

(Continued)

OTHER PUBLICATIONS

Shackelford, James F. Alexander, William. (2001). CRC Materials Science and Engineering Handbook (3rd Edition). (pp. 386-406). Taylor & Francis. Online version available at: http://app.knovel.com/hotlink/toc/id:kpCRCMSEH3/crc-materials-science/crc-materials-science.*

(Continued)

*Primary Examiner* — Frantz F Jules
*Assistant Examiner* — Erik Mendoza-Wilkenfel
(74) *Attorney, Agent, or Firm* — Michael Best & Friedrich LLP

(57) ABSTRACT

A regenerative refrigerator includes: a regenerator unit that precools a working gas; and an expander that cools the working gas by expanding the working gas precooled by the regenerator unit. The regenerator unit includes a zinc based regenerator member formed of zinc or an alloy containing zinc as a main component of the alloy. A first stage regenerator optionally includes a high temperature part including a first regenerator member and a low temperature part including a second regenerator member different from the first regenerator member. A second stage regenerator optionally includes a high temperature part including a second regenerator member and a low temperature part including a third regenerator member different from the second regenerator member. The second regenerator member optionally (Continued)

includes a zinc based regenerator member formed of zinc or an alloy containing zinc as a main component of the alloy.

13 Claims, 9 Drawing Sheets

(51) Int. Cl.

| | |
|---|---|
| ***B01D 8/00*** | (2006.01) |
| ***F25B 9/14*** | (2006.01) |
| ***F25B 9/10*** | (2006.01) |

(56) References Cited

U.S. PATENT DOCUMENTS

| | | | | |
|---|---|---|---|---|
| 6,469,085 | B1 | 10/2002 | Mizutani | |
| 7,226,543 | B2 | 6/2007 | Takagimi et al. | |
| 9,086,231 | B2 | 7/2015 | Xu et al. | |
| 2005/0166600 | A1* | 8/2005 | Mitsubori | F25B 9/14 62/6 |
| 2005/0217280 | A1 | 10/2005 | Gschneidner, Jr. et al. | |
| 2005/0223714 | A1* | 10/2005 | Li | F25B 9/145 62/6 |
| 2007/0130961 | A1* | 6/2007 | Xu | F25B 9/14 62/6 |
| 2007/0227159 | A1 | 10/2007 | Murayama et al. | |
| 2008/0104967 | A1 | 5/2008 | Satoh | |
| 2009/0302844 | A1 | 12/2009 | Saito et al. | |
| 2011/0126553 | A1* | 6/2011 | Ball-DiFazio | F04B 37/08 62/6 |
| 2012/0060519 | A1* | 3/2012 | Tanaka | F04B 37/085 62/55.5 |
| 2012/0204579 | A1* | 8/2012 | Xu | F25B 9/145 62/6 |
| 2012/0304668 | A1 | 12/2012 | Xu | |

FOREIGN PATENT DOCUMENTS

| | | | |
|---|---|---|---|
| CN | 102635967 | A | 8/2012 |
| CN | 102812311 | A | 12/2012 |
| JP | S60-23761 | A | 2/1985 |
| JP | H03-117855 | A | 5/1991 |
| JP | H11-37582 | A | 2/1999 |
| JP | H11-264618 | A | 9/1999 |
| JP | 2002-295914 | A | 10/2002 |
| JP | 2003-028526 | A | 1/2003 |
| JP | 2003-073661 | A | 3/2003 |
| JP | 2004-225920 | A | 8/2004 |
| JP | 2005-201604 | A | 7/2005 |
| JP | 2007-132655 | A | 5/2007 |
| JP | 2009-008385 | A | 1/2009 |
| JP | 2009-293909 | A | 12/2009 |
| JP | 2012-255590 | A | 12/2012 |
| WO | WO-2006-022297 | A1 | 3/2006 |
| WO | WO-2011/089768 | A1 | 7/2011 |

OTHER PUBLICATIONS

Robert J. Corruccini, "Specific Heats and Enthalpies of Technical Solids at Low Temperatures", 1960, pp. 1-20.*

Mingyao Xu and Takaaki Morie, "Numerical Simulation of the Second Stage Regenerator in a 4K GM Cryocooler", Cryogenic Engineering Conference & International Cryogenic material Conference 2013, Jun. 21, 2013, 7 sheets (including cover sheet).

* cited by examiner

REGENERATIVE REFRIGERATOR, FIRST STAGE REGENERATOR, AND SECOND STAGE REGENERATOR

BACKGROUND OF THE INVENTION

1. Field of the Invention

The present invention relates to a regenerative refrigerator, a first stage regenerator, and a second stage regenerator.

2. Description of the Related Art

A regenerative refrigerator is used to cool an object to a temperature ranging from about 100 K (Kelvin) to about 4 K. A regenerative refrigerator is exemplified by a Gifford-McMahon (GM) refrigerator, a pulse tube refrigerator, a Stirling refrigerator, and a Solvay refrigerator. A regenerative refrigerator is used to cool a superconducting magnet or a detector or used in a cryopump, etc. The refrigerating capacity of a regenerative refrigerator is determined by the heat exchange efficiency of a regenerator material.

SUMMARY OF THE INVENTION

An illustrative purpose of an embodiment of the present invention is to improve the refrigerating capacity of a regenerative refrigerator.

According to an embodiment of the present invention, there is provided a regenerative refrigerator including: a regenerator unit that precools a working gas; and an expander that cools the working gas by expanding the working gas precooled by the regenerator unit. The regenerator unit includes a zinc based regenerator member formed of zinc or an alloy containing zinc as a main component of the alloy.

According to an embodiment of the present invention, there is provided a first stage regenerator including a high temperature part including a first regenerator member and a low temperature part including a second regenerator member different from the first regenerator member. The second regenerator member includes a zinc based regenerator member formed of zinc or an alloy containing zinc as a main component of the alloy.

According to an embodiment of the present invention, there is provided a second stage regenerator including a high temperature part including a second regenerator member and a low temperature part including a third regenerator member different from the second regenerator member. The second regenerator member includes a zinc based regenerator member formed of zinc or an alloy containing zinc as a main component of the alloy.

Optional combinations of the aforementioned constituting elements, and implementations of the invention in the form of methods, apparatuses, and systems may also be practiced as additional modes of the present invention.

BRIEF DESCRIPTION OF THE DRAWINGS

Embodiments will now be described, by way of example only, with reference to the accompanying drawings that are meant to be exemplary, not limiting, and wherein like elements are numbered alike in several figures, in which.

DETAILED DESCRIPTION OF THE INVENTION

The invention will now be described by reference to the preferred embodiments. This does not intend to limit the scope of the present invention, but to exemplify the invention.

A detailed description of an embodiment to implement the present invention will be given with reference to the drawings. Like numerals are used in the description to denote like elements and the description is omitted as appropriate. The structure described below is by way of example only and does not limit the scope of the present invention.

Figure 1:
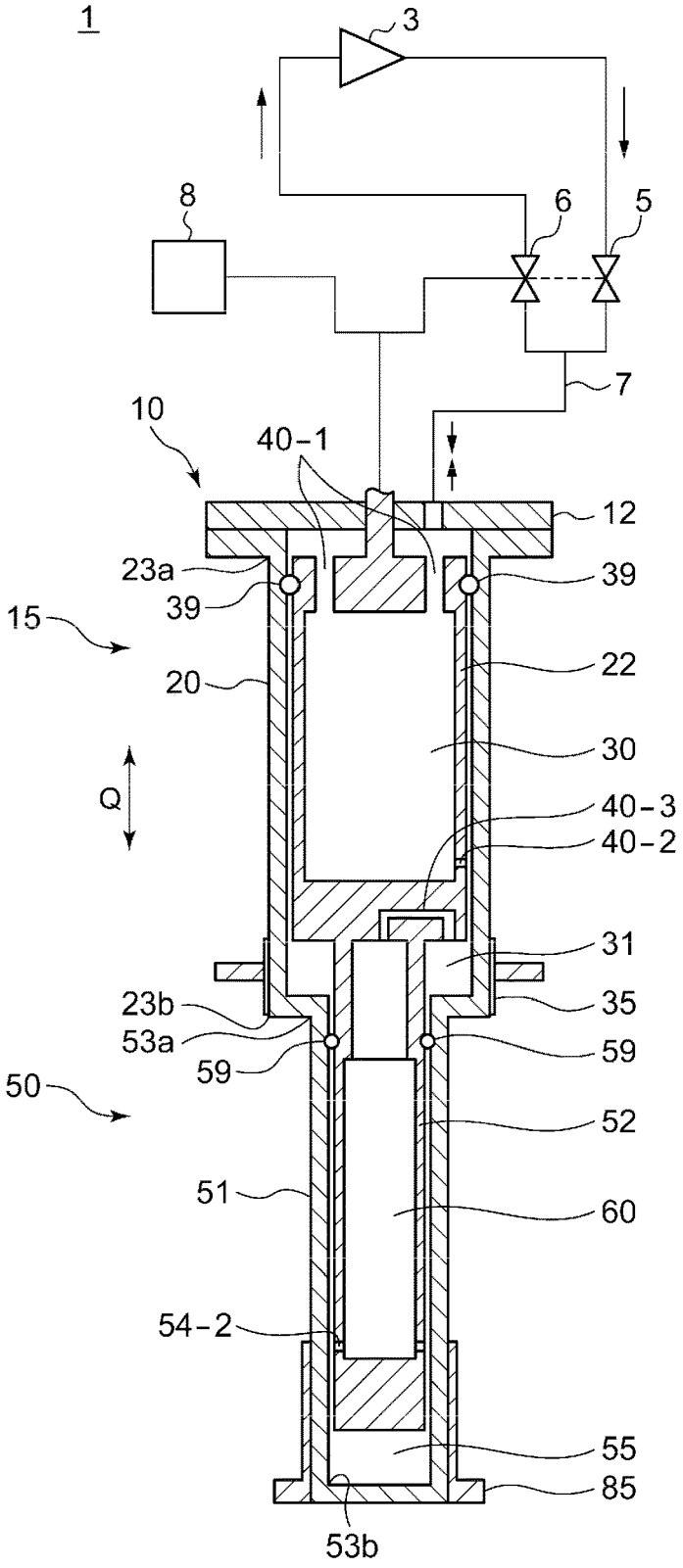
FIG. 1 schematically shows a regenerative refrigerator according to an embodiment of the present invention.

FIG. 1 schematically shows a regenerative refrigerator according to an embodiment of the present invention. A regenerative refrigerator such as a GM refrigerator 1 includes a regenerator unit, an expander, and a compressor. In most cases, the regenerator unit is provided in the expander. The regenerator unit is configured to precool a working gas (e.g., helium gas). The expander includes a space to expand the working gas precooled by the regenerator unit so as to further cool the precooled working gas. The regenerator unit is configured to be cooled by the working gas cooled by expansion. The compressor is configured to collect and compress the working gas from the regenerator and supply the working gas to the regenerator unit again.

In a two-stage refrigerator such as the GM refrigerator 1 as shown in the figure, the regenerator unit includes a first stage regenerator and a second stage regenerator. The first stage regenerator is configured to precool the working gas supplied from the compressor to a low temperature end temperature of the first stage regenerator. The second stage regenerator is configured to precool the working gas precooled by the first stage regenerator to a low temperature end temperature of the second stage regenerator.

The GM refrigerator 1 includes a gas compressor 3 that functions as a compressor, and a two-stage cold head 10 that functions as an expander. The cold head 10 includes a first stage cooler 15 and a second stage cooler 50. These coolers are coaxially coupled to a flange 12. The first stage cooler 15 includes a first stage high temperature end 23*a* and a first stage low temperature end 23*b*, and the second stage cooler 50 includes a second stage high temperature end 53*a* and a second stage low temperature end 53*b*. The first stage cooler 15 is serially coupled to the second stage cooler 50. Therefore, the first stage low temperature end 23*b* corresponds to the second stage high temperature end 53*a*.

The first stage cooler 15 includes a first stage cylinder 20, a first stage displacer 22, a first stage regenerator 30, a first stage expansion chamber 31, and a first stage cooling stage 35. The first stage cylinder 20 is a hollow airtight container. The first stage displacer 22 is provided in the first stage cylinder 20 so as to be capable of moving reciprocally in an axial direction Q. The first stage regenerator 30 includes a first stage regenerator member filling the first stage displacer 22. Therefore, the first stage displacer 22 is a container for accommodating the first stage regenerator member. The first stage expansion chamber 31 is formed in the first stage cylinder 20 toward the first stage low temperature end 23*b*. The volume of the first stage expansion chamber 31 changes as a result of the reciprocal movement of the first stage displacer 22. The first stage cooling stage 35 is mounted outside the first stage cylinder 20 toward the first stage low temperature end 23*b*.

At the first stage high temperature end 23*a*, and, more specifically, on the high temperature side of the first stage regenerator 30, a plurality of first stage high temperature side passages 40-1 are provided to cause helium gas to flow into and out of the first stage regenerator 30. At the first stage low temperature end 23*b*, and, more specifically, on the low temperature side of the first stage regenerator 30, a plurality of first stage low temperature side passages 40-2 are provided to cause helium gas to flow between the first stage regenerator 30 and the first stage expansion chamber 31. Between the first stage cylinder 20 and the first stage displacer 22 is provided a first stage seal 39 for sealing a gas flow in a gap between the interior surface of the first stage cylinder 20 and the exterior surface of the first stage displacer 22. Therefore, the flow of working gas between the first stage high temperature end 23*a* and the first stage low temperature end 23*b* is directed through the first stage regenerator 30.

The second stage cooler 50 includes a second stage cylinder 51, a second stage displacer 52, a second stage regenerator 60, a second stage expansion chamber 55, and a second stage cooling stage 85. The second stage cylinder 51 is a hollow airtight container. The second stage displacer 52 is provided in the second stage cylinder 51 so as to be capable of moving reciprocally in the axial direction Q. The second stage regenerator 60 includes a second stage regenerator member filling the second stage displacer 52. Therefore, the second stage displacer 52 is a container for accommodating the second stage regenerator member. The second stage expansion chamber 55 is formed in the second stage cylinder 51 toward the second stage low temperature end 53*b*. The volume of the second stage expansion chamber 55 changes as a result of the reciprocal movement of the second stage displacer 52. The second stage cooling stage 85 is mounted outside the second stage cylinder 51 toward the second stage low temperature end 53*b*.

At the second stage high temperature end 53*a*, and, more specifically, on the high temperature side of the second stage regenerator 60, a plurality of second stage high temperature side passages 40-3 are provided to cause helium gas to flow into and out of the second stage regenerator 60. In the GM refrigerator 1 as shown, the second stage high temperature side passages 40-3 connect the first stage expansion chamber 31 to the second stage regenerator 60. At the second stage low temperature end 53*b*, and, more specifically, on the low temperature side of the second stage regenerator 60, a plurality of second stage low temperature side passages 54-2 are provided to cause helium gas to flow in and out of the second stage expansion chamber 55. Between the second stage cylinder 51 and the second stage displacer 52 is provided a second stage seal 59 for sealing a gas flow in a gap between the interior surface of the second stage cylinder 51 and the exterior surface of the second stage displacer 52. Therefore, the flow of working gas between the second stage high temperature end 53*a* and the second stage low temperature end 53*b* is directed through the second stage regenerator 60. The second stage cooler 50 may be configured to permit some gas flow in the gap between the second stage cylinder 51 and the second stage displacer 52.

The GM refrigerator 1 includes piping 7 connecting the gas compressor 3 and the cold head 10. The piping 7 includes a high pressure valve 5 and a low pressure valve 6. The GM refrigerator 1 is configured such that a high pressure helium gas is supplied from the gas compressor 3 to the first stage cooler 15 via the high pressure valve 5 and the piping 7. Further, the GM refrigerator 1 is configured such that a low pressure helium gas is discharged from the first stage cooler 15 to the gas compressor 3 via the piping 7 and the low pressure valve 6.

The GM refrigerator 1 includes a drive motor 8 for reciprocal movement of the first stage displacer 22 and the second stage displacer 52. The drive motor 8 causes the first stage displacer 22 and the second stage displacer 52 as one piece to move reciprocally in the axial direction Q. The drive motor 8 is coupled to the high pressure valve 5 and the low pressure valve 6 so as to selectively open the high pressure valve 5 and the low pressure valve 6 in turns in coordination with the reciprocal movement. Thus, the GM refrigerator 1 is configured to switch between an intake stroke and an exhaust stroke in an appropriate manner.

A description will now be given of the operation of the GM refrigerator 1 configured as described above. First, when the first stage displacer 22 and the second stage displacer 52 are placed at the bottom dead center or the neighborhood thereof of the first stage cylinder 20 and the second stage cylinder 51, respectively, the high pressure valve 5 is opened. The first stage displacer 22 and the second stage displacer 52 move from the bottom dead center toward the top dead center. All this while, the low pressure valve 6 is closed.

A high pressure helium gas flows from the gas compressor 3 into the first stage cooler 15. The high pressure helium gas flows from the first stage high temperature side passages 40-1 into the interior of the first stage displacer 22 and is cooled by the first stage regenerator 30 to a predetermined temperature. The cooled helium gas flows from the first stage low temperature side passages 40-2 into the first stage expansion chamber 31. A portion of the high pressure helium gas flowing into the first stage expansion chamber 31 flows from the second stage high temperature side passages 40-3 into the interior of the second stage displacer 52. The helium gas is cooled by the second stage regenerator 60 to an even lower predetermined temperature and flows from the second stage low temperature side passages 54-2 into the second stage expansion chamber 55. Consequently, the first stage expansion chamber 32 and the second stage expansion chamber 55 are placed in a high pressure state.

When the first stage displacer 22 and the second stage displacer 52 reach the top dead center or the neighborhood thereof of the first stage cylinder 20 and the second stage cylinder 51, respectively, the high pressure valve 5 is closed. Substantially concurrently, the low pressure valve 6 is opened. This time, the first stage displacer 22 and the second stage displacer 52 move from the top dead center toward the bottom dead center.

The helium gas in the first stage expansion chamber 31 and the second stage expansion chamber 55 loses its pressure and is expanded. As a result, the helium gas is cooled. Further, the first stage cooling stage 35 and the second stage cooling stage 85 are cooled. The low pressure helium gas flows through the above-described path in a reverse direction and returns to the gas compressor 3 via the low pressure valve 6 and the piping 7, cooling the first stage regenerator 30 and the second stage regenerator 60.

When the first stage displacer 22 and the second stage displacer 52 reach the bottom dead center or the neighborhood thereof of the first stage cylinder 20 and the second stage cylinder 51, respectively, the low pressure valve 6 is closed. Substantially concurrently, the high pressure valve 5 is opened again.

The GM refrigerator 1 repeatedly undergoes the cycle described above. Thus, the GM refrigerator 1 can absorb heat from an object (not shown) thermally coupled to the first stage cooling stage 35 and an object (not shown) thermally coupled to the second stage cooling stage 85 so as to cool the objects.

For example, the temperature of the first stage high temperature end 23*a* is a room temperature. The temperature of the first stage low temperature end 23*b* and the second stage high temperature end 53*a* (i.e., the first stage cooling stage 35) is in a range of about 20 K-about 40 K. The temperature of the second stage low temperature end 53*b* (i.e., the second stage cooling stage 85) is about 4 K.

Thus, the GM refrigerator 1 includes a part cooled to an intermediate temperature range from about 30 K to about 80 K (hereinafter, sometimes referred to as an intermediate temperature part). In one embodiment, the temperature of the first stage cooling stage 35 cooled by the first stage cooler 15 is between about 30 K and about 80 K. In this case, the intermediate temperature part includes the first stage cooler 15 and the second stage cooler 50. For example, if the temperature to which the first stage cooling stage 35 is cooled (cooling temperature) is about 40 K, the temperature range from about 40 K to about 80 K of the high temperature side of the intermediate temperature part is formed on the low temperature side of the first stage cooler 15, and the temperature range from about 30 K to about 40 K of the low temperature side of the intermediate temperature part is formed on the high temperature side of the second stage cooler 50.

If the cooling temperature of the first stage cooler 15 is lower than about 30 K, the first stage cooler 15 includes the intermediate temperature part. If the cooling temperature of the first stage cooler 15 is higher than about 80 K, the second stage cooler 50 includes the intermediate temperature part. The intermediate temperature part may be a part cooled to a temperature range from about 30 K to about 65 K.

Figure 2:
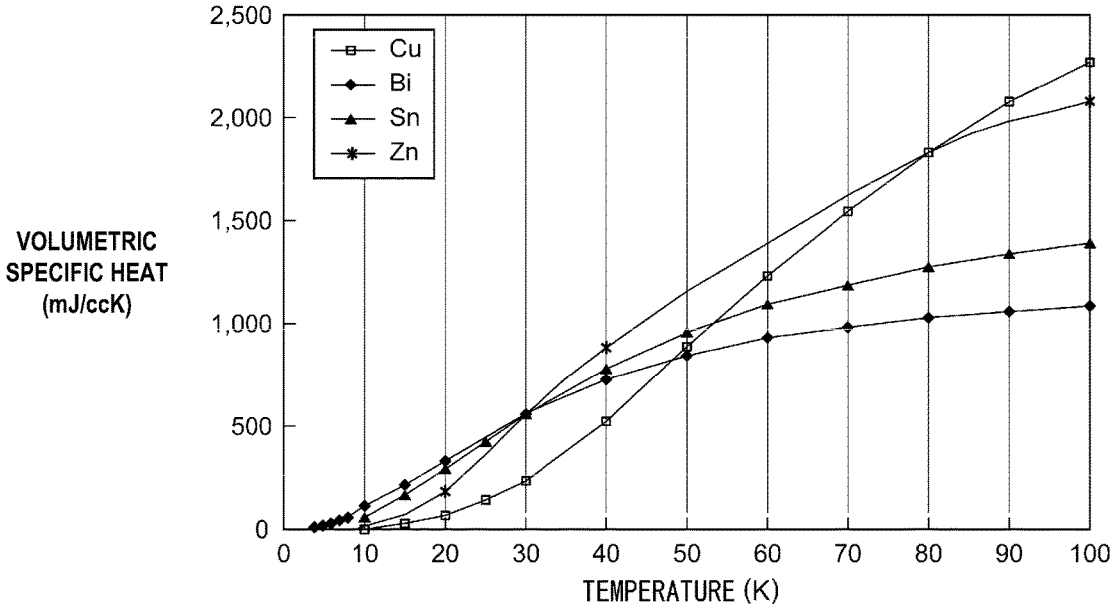
FIG. 2 is a graph showing the relationship between volumetric specific heat and temperature of metals.

FIG. 2 is a graph showing the relationship between volumetric specific heat and temperature of metals. FIG. 2 shows that the volumetric specific heat of zinc and the volumetric specific heat of copper are substantially equal at 80 K. At a temperature lower than 80 K, the volumetric specific heat of zinc is larger than the volumetric specific heat of copper. Further, the volumetric specific heat of zinc is substantially equal to the volumetric specific heat of bismuth or tin at 30 K. At a temperature higher than 30 K, the volumetric specific heat of zinc is larger than the volumetric specific heat of bismuth or tin. Bismuth and tin are typical substances that can be used as a regenerator material to substitute lead, or a lead-free regenerator material, at a temperature between about 5 K and about 30 K.

Accordingly, the regenerator unit according to an embodiment of the present invention includes a high temperature part including a first regenerator member, an intermediate temperature unit including a second regenerator member, and a low temperature part including a third regenerator member. The second regenerator member includes a zinc based regenerator member or a regenerator member formed of a zinc based regenerator material. Details will be described later. The first regenerator member is different from the second regenerator member and is formed of a material suited to a temperature range higher than 80 K (or 65 K). The first regenerator member is formed of a material having a specific heat larger than that of a zinc based regenerator material at least in part of this high temperature range. The third refrigerator member is different from the second regenerator member and is formed of a material suited to a temperature range lower than 30 K. The third regenerator member is formed of a material having a specific heat larger than that of a zinc based regenerator material at least in part of this low temperature range.

Figure 3:
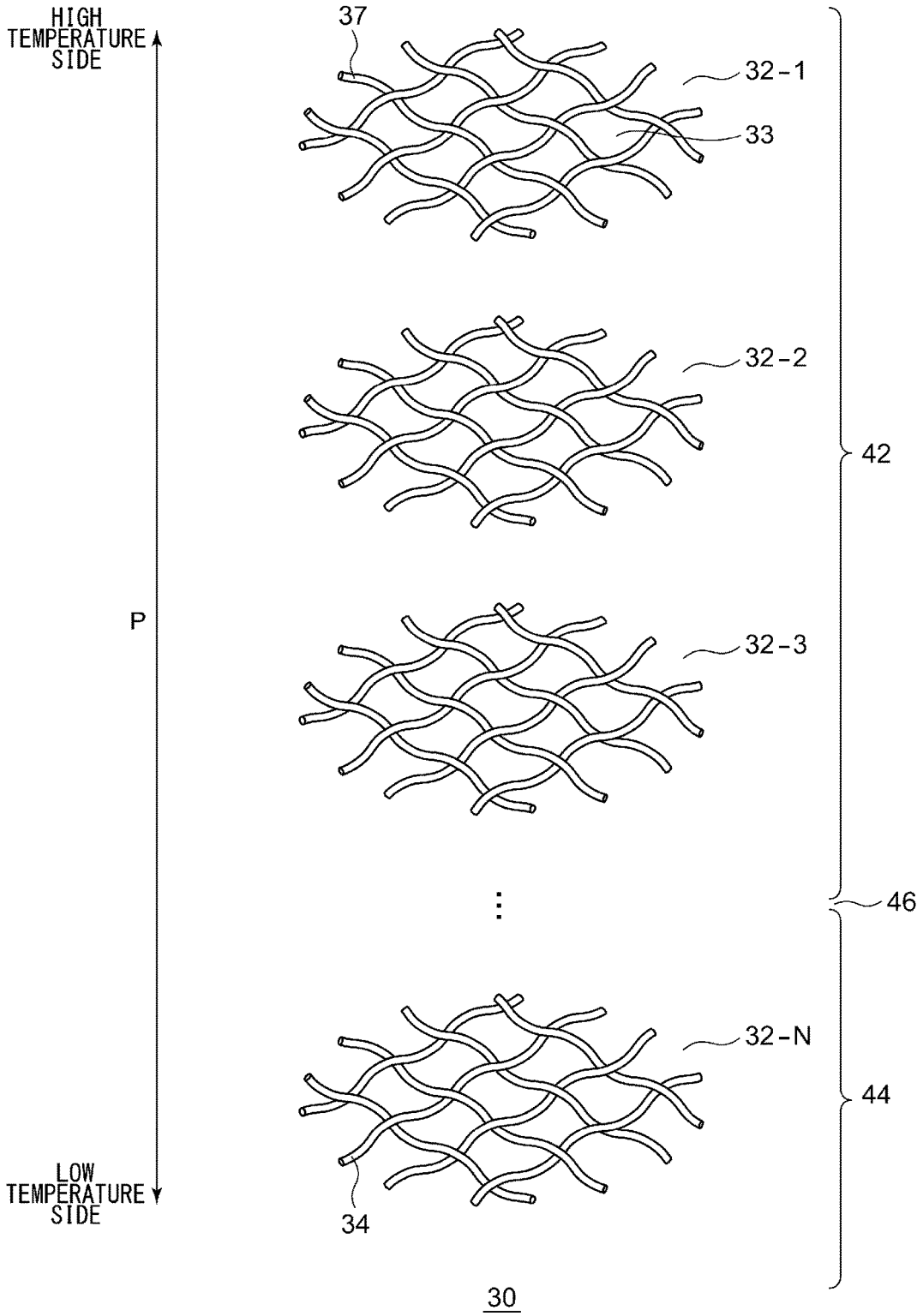
FIG. 3 is a schematic diagram showing the structure of a first stage regenerator according to an embodiment of the present invention.

FIG. 3 is a schematic diagram showing the structure of the first stage regenerator 30 according to an embodiment of the present invention. The first stage regenerator 30 has a laminated structure built by stacking a total of N (N is a natural number equal to or greater than 2) layers of first stage regenerator members in a lamination direction P. For example, the first stage regenerator member is provided with wire meshes 32-1-32-N. The lamination direction P is substantially parallel to a direction of flow of the working gas. In other words, the working gas moves in the first stage regenerator 30 along the lamination direction P. The lamination direction P is also substantially parallel to the axial direction Q of the cold head 10, i.e., a direction of movement of the first stage displacer 22 (see FIG. 1).

The wire meshes 32-1-32-N forming the layers are formed by weaving wire members having a specified wire diameter and a specified material. The plane defined by each of the wire meshes 32-1-32-N forming the respective layers is substantially perpendicular to the lamination direction P. Helium gas passes through a plurality of openings 33 of the wire meshes 32-1-32-N forming the respective layers as it flows in the first stage regenerator 30 along the lamination direction P.

The wire meshes 32-1-32-N may be of about 100 mesh or larger. As is known, mesh is a unit indicating the number of openings per inch. If wire meshes of less than 100 mesh are used, the volume of wire members occupying the space will be small and so will not be suitable as a regenerator. Further, for reason of manufacturing, the wire meshes 32-1-32-N may be of about 400 mesh or below, or 250 mesh or below.

The first stage regenerator 30 is configured differently in a high temperature part 42 and in a low temperature part 44. The first stage regenerator 30 is configured such that the temperature at a boundary 46 between the high temperature part 42 and the low temperature part 44 is about 80 K (or about 65 K) during normal operation of the regenerative refrigerator (e.g., the GM refrigerator 1). The boundary 46 is substantially perpendicular to the direction of flow of the working gas.

The first stage regenerator member placed in the high temperature part 42 includes a copper based regenerator member or a regenerator material formed of a copper based regenerator material. The copper based regenerator material is comprised of copper or an alloy containing copper as a main component of the alloy. The copper based regenerator material may be made of phosphor bronze, red brass, pure copper, touch pitch copper, or oxygen free copper. Alternatively, the first stage regenerator member placed in the high temperature part 42 may include an iron based regenerator material such as stainless steel. Therefore, those of the N wire meshes 32-1-32-N on the high temperature side are formed of a copper based or iron based wire member 37 as described above. The wire member 37 may include a base member of the copper based or iron based material and a coating layer coating the base member. The coating layer may be provided to protect the base member. The coating layer may include chromium.

The first stage regenerator member placed in the low temperature part 44 includes a zinc based regenerator material. The zinc based regenerator material is comprised of zinc or an alloy containing zinc as a main component of the alloy (hereinafter, sometimes referred to as a zinc based metal). If the zinc based regenerator material is comprised of zinc, the zinc based regenerator material may contain inevitable impurities. The zinc based metal may contain zinc at least in the amount of about 50 wt %. The zinc based metal may contain chromium.

In one embodiment, those of the N wire meshes 32-1-32-N on the low temperature side are formed of a zinc based wire member 34 as described above. The wire member 34 may include a base member of the zinc based metal and a coating layer coating the base member. The coating layer may be provided to protect the base member. The coating layer may include chromium.

Figure 4:
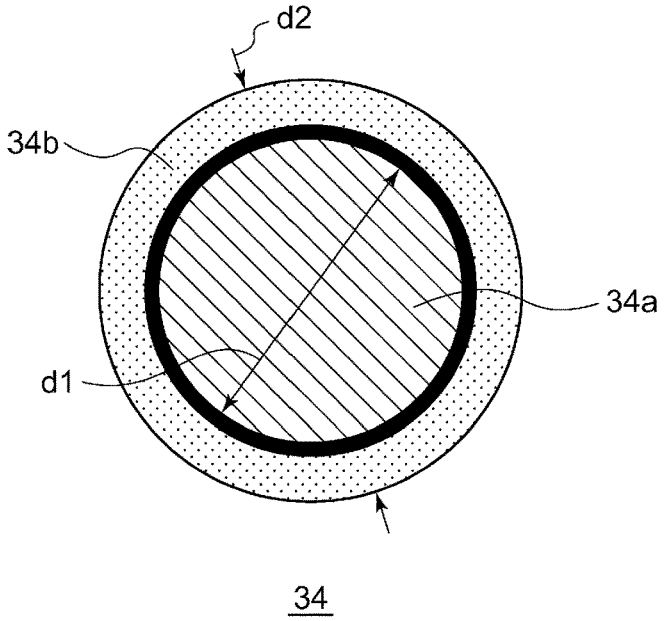
FIG. 4 is a cross sectional view of a wire member on the low temperature side of a first stage regenerator according to an embodiment of the present invention.

In one embodiment, the wire member 34 may include a base member and a zinc based metal layer coating the base member. This is illustrated in FIG. 4. FIG. 4 is a cross sectional view of the wire member 34 on the low temperature side of the first stage regenerator 30 according to an embodiment of the present invention. As shown in FIG. 4, the wire member 34 may include a base member 34*a* and a zinc based metal layer 34*b* coating the base member 34*a*. As in the case of the high temperature side, the base member 34*a* is formed of a copper based or iron based wire member. The zinc based metal layer 34*b* is formed by plating on the base member 34*a*. An additional coating layer for protecting the layer 34*b* may be formed on the layer 34*b*.

If the layer 34*b* is too thin, the advantage of the layer 34*b* to increase specific heat is reduced. Meanwhile, if the layer 34*b* is too thick, the opening of the wire mesh will be small so that channel resistance is increased or the base member 34*a* becomes thin, causing heat conduction to become poor. It can therefore be ensured that, given that the diameter of the base member 34*a* in the cross section is d1 and the outer diameter of the layer 34*b* is d2 (see FIG. 4), the ratio d2/d1 of the diameters of the wire member 34 be, for example, in a range from 1.3 to 1.5.

In one embodiment, the heat conductivity of the base member 34*a* in the intermediate temperature range described above may be higher than the heat conductivity of the layer 34*b*. A copper based material having a relatively high heat conductivity (e.g., a copper based material having a heat conductivity higher than that of phosphor bronze, which means, e.g., red brass, pure copper, touch pitch copper, oxygen free copper) may be suitably used to form the base member 34*a*. By ensuring a relatively high heat conductivity of the base member 34*a*, heat conduction through the base member 34*a* is promoted and temperature difference in the radial direction of the regenerator (a direction perpendicular to the lamination direction P) can be reduced. This contributes to improvement in the efficiency of heat exchange in the first stage regenerator 30.

In one embodiment, the first stage regenerator member placed in the low temperature part 44 may include a spherically shaped zinc based regenerator material.

Figure 5:
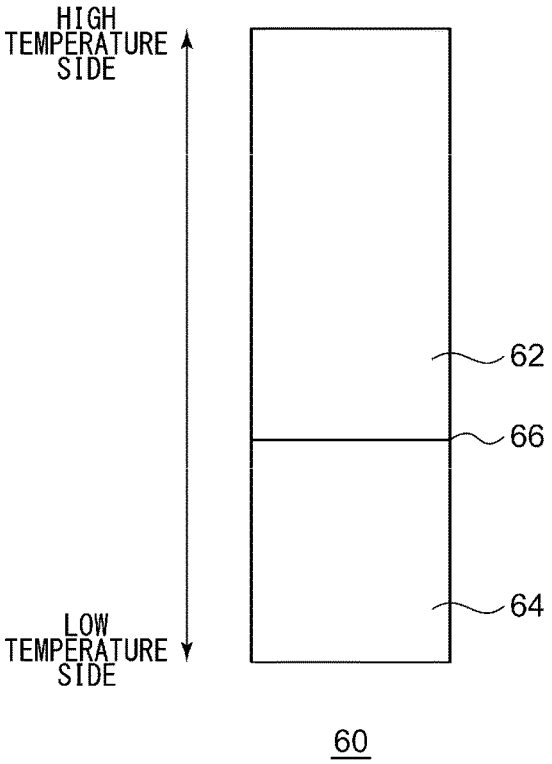
FIG. 5 is a schematic diagram showing the structure of a second stage regenerator according to an embodiment of the present invention.

FIG. 5 is a schematic diagram showing the structure of the second stage regenerator 60 according to an embodiment of the present invention. The second stage regenerator 60 is configured differently in a high temperature part 62 and in a low temperature part 64. The second stage regenerator 60 is configured such that the temperature at a boundary 66 between the high temperature part 62 and the low temperature part 64 is about 30 K during normal operation of the regenerative refrigerator (e.g., the GM refrigerator 1).

For example, the second stage refrigerator member is formed of spherical particles. Therefore, a partition member for partitioning between the high temperature part 62 and the low temperature part 64 may be provided in the boundary 66. The boundary 66 is substantially perpendicular to the direction of flow of working gas. The particle diameter is in a range from 0.1 mm to 1 mm or a range from 0.2 mm to 0.5 mm. The particle diameter in the high temperature part 62 may be larger than the particle diameter in the low temperature part 64.

The second stage regenerator member placed in the high temperature part 62 includes a zinc based regenerator material. As described above, the zinc based regenerator material is comprised of a zinc based metal. Therefore, the high temperature side of the second stage regenerator 60 is filled with, for example, spherical zinc particles. In one embodiment, the high temperature part 62 may be configured similarly as the low temperature side of the first stage regenerator 30. In other words, the high temperature part 62 may include wire meshes that include a part (e.g., a base member or a layer) formed of a zinc based metal.

The second stage regenerator member placed in the low temperature part 64 may be formed of a magnetic regenerator material such as $HoCu_2$. The magnetic regenerator material is implemented by using, as a regenerator, a magnetic body having a specific heat that increases in association with magnetic phase transition at an extremely low temperature. Alternatively, the second stage regenerator placed in the low temperature part 64 may be formed of a material such as bismuth, tin, or lead having a high specific heat at the temperature of the second stage low temperature end 53*b*.

For the purpose of environment protection, the zinc based regenerator material may not contain lead (except when it is inevitable impurity). Similarly, regenerator materials other than a zinc based regenerator material may not contain lead (except when it is inevitable impurity).

According to the embodiment described above, a regenerator member for high temperature, a regenerator member for intermediate temperature, and a regenerator member for low temperature are placed in the high temperature part, the intermediate temperature part, and the low temperature part of the refrigerator, respectively. It should be particularly appreciated that the specific heat of the low temperature part of the first stage regenerator 30 and the high temperature part of the second stage regenerator 60 can be increased, by using a zinc based regenerator member in the intermediate temperature part. Consequently, the efficiency of heat exchange in the first stage regenerator 30 and the second stage regenerator 60, and, ultimately, the refrigerating capacity of the refrigerator can be enhanced.

It should additionally be noted that use of zinc, or an alloy containing zinc as a main component of the alloy, as a regenerator member of a regenerative refrigerator in the temperature range from 30 K to 80 K has not been known.

Red brass, which exemplifies the copper based material described above, is an alloy of copper and zinc and contains copper as a main component. Generally red brass contains about 90% of copper and about 10% of zinc. The proportion of zinc is about 20% at most. Therefore, red brass is not an alloy that contains zinc as a main component.

Figure 6:
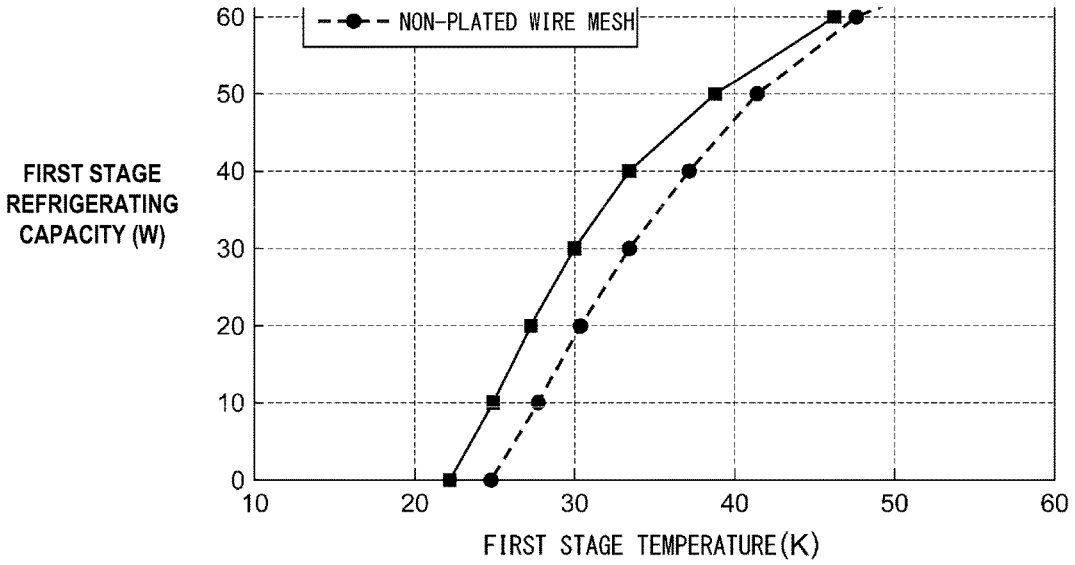
FIG. 6 is a graph showing the refrigerating capacity of a regenerative refrigerator according an embodiment of the present invention.

FIG. 6 is a graph showing the refrigerating capacity of a regenerative refrigerator according an embodiment of the present invention. FIG. 6 shows the relationship between the temperature of the first stage cooling stage 35 and the refrigerating capacity measured in the GM refrigerator 1. In the graph shown in FIG. 6, circles indicate results of measurement performed when the wire meshes of the first stage regenerator 30 are not plated with zinc, and squares indicate results of measurement performed when the wire meshes of the first stage regenerator 30 on the low temperature side are plated with zinc.

The graph shows that the first stage refrigerating capacity in the presence of zinc plating is higher than the first stage refrigerating capacity in the absence of zinc plating in the temperature range not exceeding about 50 K. For example, the first stage refrigerating capacity at 40 K is improved from 46.6 W in the absence of plating to 51.6 W in the presence of plating, i.e., by about 11%. The lower the temperature is, the greater the advantage of zinc plating is. For example, the first stage refrigerating capacity at 30 K is improved from 18.7 W in the absence of plating to 30.0 W in the presence of plating, i.e., by about 60%.

Described above is an explanation based on an exemplary embodiment. The embodiment is intended to be illustrative only and it will be obvious to those skilled in the art that various modifications to constituting elements and processes could be developed and that such modifications are also within the scope of the present invention.

In the embodiments described above, the low temperature side of the second stage regenerator includes a regenerator material different from a zinc based regenerator material. However, the low temperature side of the second stage regenerator may include a zinc based regenerator material. In this case, the whole of the second stage regenerator may be formed of, for example, spherical zinc particles. Zinc particles are available at a low price. Therefore, the second stage regenerator can be manufactured at a cost lower than when using a substitute for lead such as bismuth. Such a feature is suitably implemented in a refrigerator in which the temperature of the second stage low temperature end is higher than about 10 K.

The peak of specific heat of helium used as a working gas is about 10 K. The peak of density difference of helium is also about 10 K, which is substantially equal to the peak of specific heat. The density difference of helium is a difference between the density of helium supplied at a high pressure from the compressor and the density of helium at a low pressure occurring subsequent to expansion. Therefore, in the case that the low temperature end of the second regenerator is cooled to a level of 4 K, the peak of specific heat and density difference of helium occurs in an intermediate part of the second stage regenerator in the axial direction (direction of flow of helium).

We have discovered that the refrigerating capacity of a regenerative refrigerator is improved by reducing the specific heat of regenerator material in the peak zone of specific heat of working gas and in the peak zone of density difference between low pressure/high pressure of working gas. By providing a regenerator having a relatively small specific heat in the intermediate part, the temperature of that part is ensured to be relatively high (this translates into moderating the temperature profile of the second stage regenerator as compared with the case of configuring the whole of the second stage regenerator using a regenerator having a relatively large specific heat). By increasing the temperature in the intermediate part, the amount of gas that stays in that part is reduced. This results in increase in the amount of gas flowing into the second stage expansion chamber and is expected to improve the cooling effect as a result.

Therefore, in another embodiment, the second stage regenerator 60 may include a portion cooled to a temperature range from about 5 K to about 30 K (or about 20 K) and the portion may include a zinc based regenerator material. In this case, the second stage regenerator 60 is configured such that the temperature at the boundary 66 between the high temperature part 62 and the low temperature part 64 is about 5 K (e.g., between 5 K and 8 K, both inclusive) during normal operation of the regenerative refrigerator (e.g., the GM refrigerator 1). The second stage regenerator 60 may include an additional boundary more toward the high temperature side than the boundary 66 (e.g., at a temperature higher than 20 K). The second stage regenerator 60 may be provided with a zinc based regenerator material on the low temperature side of the additional boundary, and, on the high temperature side, with a regenerator material having a larger specific heat than a zinc based regenerator material at a temperature of the high temperature side. Alternatively, the second stage regenerator 60 may be provided with a zinc based regenerator material on the high temperature side of the additional boundary, and, on the low temperature side, with a regenerator material having a larger specific heat than the zinc based regenerator material at a temperature of the low temperature side.

Figure 7:
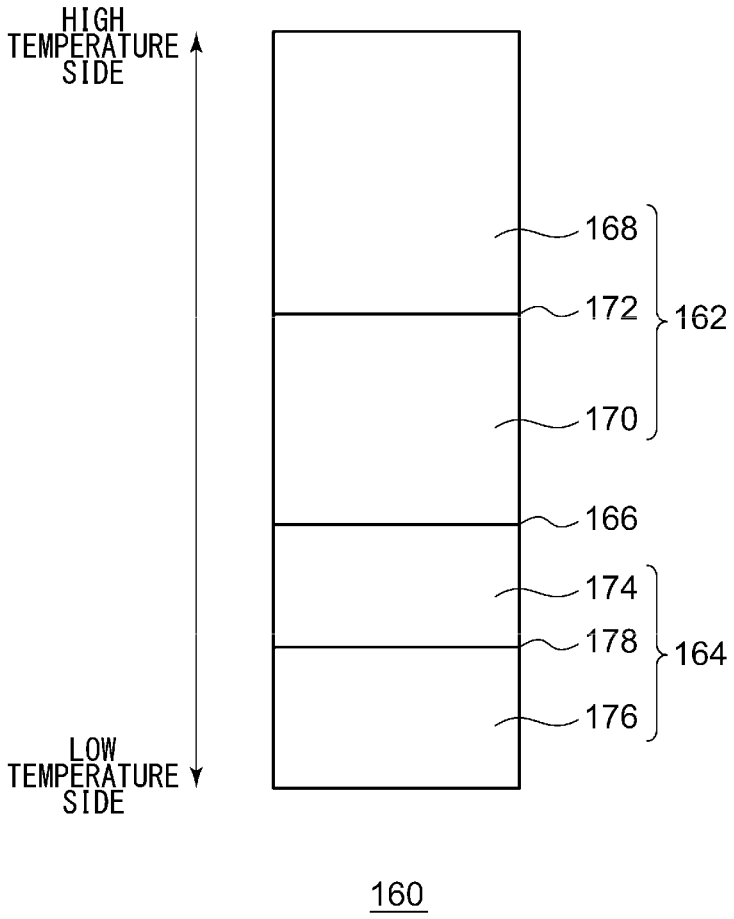
FIG. 7 is a schematic diagram showing the structure of a second stage regenerator according to an embodiment of the present invention.

FIG. 7 is a schematic diagram showing the structure of a second stage regenerator 160 according to an embodiment of the present invention. The second stage regenerator 160 includes a high temperature regenerator part 162 and a low temperature regenerator part 164. The high temperature regenerator part 162 and the low temperature regenerator part 164 are adjacent to each other. The second stage regenerator 160 is configured such that the temperature at a boundary 166 between the high temperature regenerator part 162 and the low temperature regenerator part 164 is between about 5 K and about 10 K during normal operation of the regenerative refrigerator (e.g., the GM refrigerator 1).

The high temperature regenerator part 162 includes a first block 168 and a second block 170 adjacent to the first block 168 on the low temperature side. The high temperature regenerator part 162 is provided with a boundary 172 between the first block 168 and the second block 170. The first block 168 includes a zinc based regenerator material (e.g., zinc based metal such as zinc). The second block 170 includes a non-magnetic regenerator material different from a zinc based regenerator material. The volumetric specific heat of the non-magnetic regenerator material at the temperature of the second block 170 or the boundary 166 (e.g., about 10 K) is larger than the volumetric specific heat of a zinc based regenerator material (e.g., zinc). The non-magnetic regenerator material is exemplified by bismuth. In one embodiment, the non-magnetic regenerator material may be tin. In one embodiment, the non-magnetic regenerator material may contain bismuth and/or tin.

The low temperature regenerator part 164 includes a third block 174 and a fourth block 176 adjacent to the third block 174 on the low temperature side. The low temperature regenerator part 164 is provided with a boundary 178 between the third block 174 and the fourth block 176. A magnetic regenerator material fills the third block 174 and the fourth block 176. A first magnetic regenerator material (e.g., $HoCu_2$) is used to fill the third block 174 and a second magnetic regenerator material (e.g., $Gd_2O_2S$ (GOS)) different from the first magnetic regenerator material is used to fill the fourth block 176. In one embodiment, one type of magnetic regenerator material may be used to fill the low temperature regenerator part 164.

For example, the second stage regenerator member is formed by spherically formed particles. Thus, a partition member may be provided in each of the boundaries 166, 172, and 178. The boundaries 166, 172, and 178 are substantially perpendicular to the direction of flow of working gas.

Figure 8:
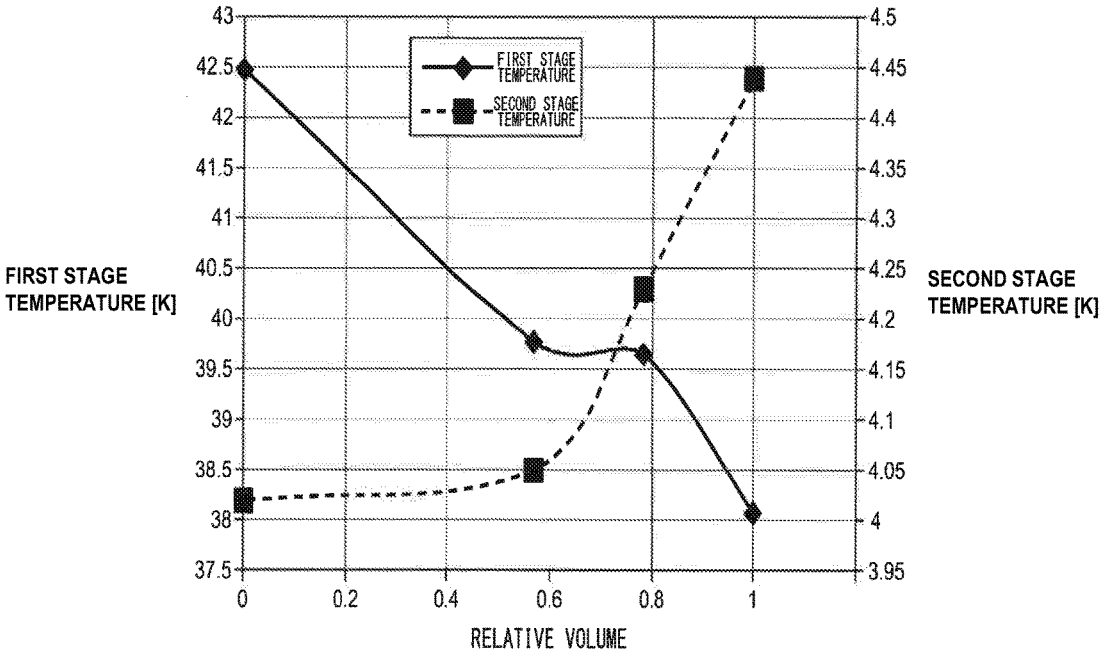
FIG. 8 is a graph showing results of a performance test of a regenerative refrigerator according to an embodiment of the present invention.

FIG. 8 is a graph showing results of a performance test of the regenerative refrigerator according to an embodiment of the present invention. FIG. 8 shows the relationship of the temperature of the first stage cooling stage 35 and the second stage cooling stage measured in the GM refrigerator 1 including the second stage regenerator 160 shown in FIG. 7, with respect to the relative volume of the first block 168 in the high temperature regenerator part 162 (i.e., the proportion occupied by the first block 168 within the total volume of the high temperature regenerator part 162). A heat load is applied to each of the first stage cooling stage 35 and the second stage cooling stage 85. Temperature measurements plots in the first stage cooling stage 35 are shown by rhombic marks and temperature measurement plots in the second stage cooling stage 85 are shown by square marks.

In this embodiment, the first block 168 of the high temperature regenerator part 162 is filled with zinc, and the second block 170 of the high temperature regenerator part 162 is filled with bismuth. Therefore, if the relative volume of the first block 168 shown in FIG. 8 is 1, the high temperature regenerator part 162 only contains zinc and does not contain bismuth. Conversely, if the relative volume is 0, the high temperature regenerator part 162 only contains bismuth and does not contain zinc. If the relative volume is 0.5, the high temperature half of the high temperature regenerator part 162 is filled with zinc and the low temperature half of the high temperature regenerator part 162 is filled with bismuth.

As shown in FIG. 8, as the relative volume of the first block 168 in the high temperature regenerator part 162 (i.e. the relative volume of a zinc based regenerator material or zinc in the high temperature regenerator part 162) increases from 0 toward 1, the temperature of the first stage cooling stage 35 is lowered. This is due to the same reason that produces increase in the first stage refrigerating capacity described with reference to FIG. 6. Meanwhile, as the relative volume of the first block 168 in the high temperature regenerator part 162 is increased, the temperature of the second stage cooling stage 85 is increased to some extent.

Thus, as shown in the graph, an optimum value of the relative volume of the first block 168 in the high temperature regenerator part 162 is found that allows both the temperature of the first stage cooling stage 35 and the temperature of the second stage cooling stage 85 to maintain at a relatively low level. The relative volume of the first block 168 in the high temperature regenerator part 162 can be selected from a range from 0.4 to 0.8 and, more specifically, from a range from 0.5 to 0.7. By using the aforementioned relative volume to configure the high temperature regenerator part 162 to have a dual structure including zinc and bismuth, both the first cooling state 35 and the second stage cooling stage 85 can be properly cooled.

Figure 9:
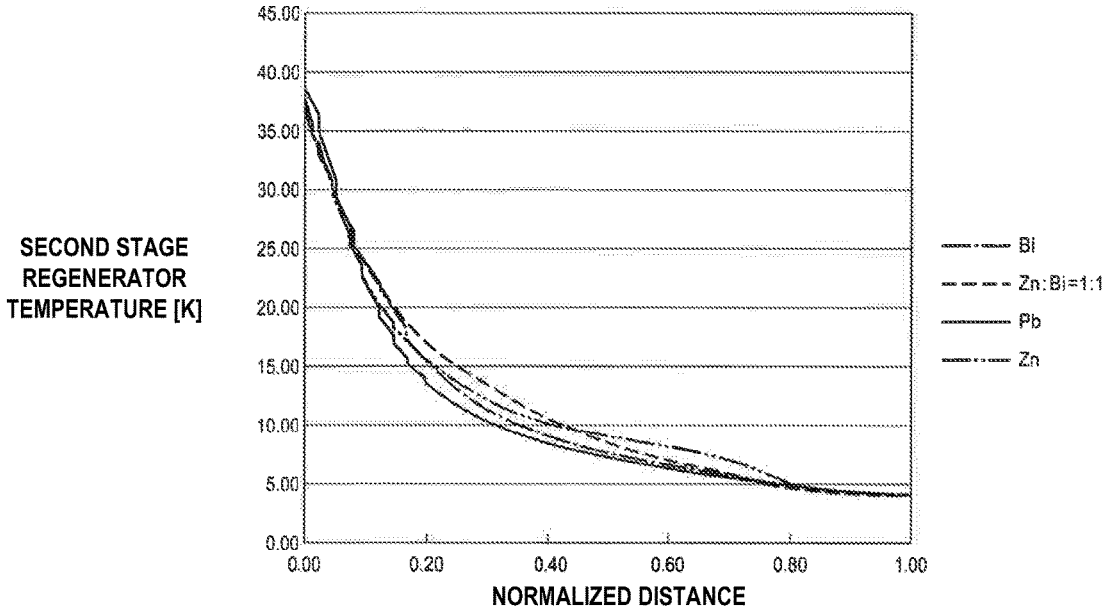
FIG. 9 shows an exemplary temperature profile of a second stage regenerator according to an embodiment of the present invention.

FIG. 9 shows an exemplary temperature profile of the second stage regenerator 160 according to an embodiment of the present invention. FIG. 9 shows a temperature profile of the second stage regenerator 160 with respect to a normalized distance where the length from the high temperature end to the low temperature end of the second stage regenerator 160 is defined to be 1. The temperature profile of the second stage regenerator 160 does not show linear decrease from the high temperature end to the low temperature end. Rather, a large temperature drop is seen near the high temperature end. As shown in FIG. 9, the temperature at the high temperature end (normalized distance of 0) of the second stage regenerator 160 is about 40 K, and the temperature at the low temperature end (normalized distance of 1) is below 5 K. The temperature profile of the second stage regenerator 160 shows a drop to about 10 K in a normalized distance range of 0.2-0.4.

FIG. 9 shows four cases that differ in the non-magnetic regenerator material filling the high temperature regenerator part 162. In three of the four cases, one kind of regenerator material (lead (Pb), bismuth (Bi), or zinc (Zn)) is used to fill the high temperature regenerator part 162. The remaining one is a case where the relative volume of the first block 168 in the high temperature regenerator part 162 is 0.5 (Zn:Bi=1:1).

As shown in the graph, the temperature in a normalized distance range of about 0.2-about 0.4 is the highest among the four cases when Zn:Bi=1:1. This obtains the most "moderate" temperature profile. Accordingly, the second stage refrigerating capacity is improved as described above.

Figure 10:
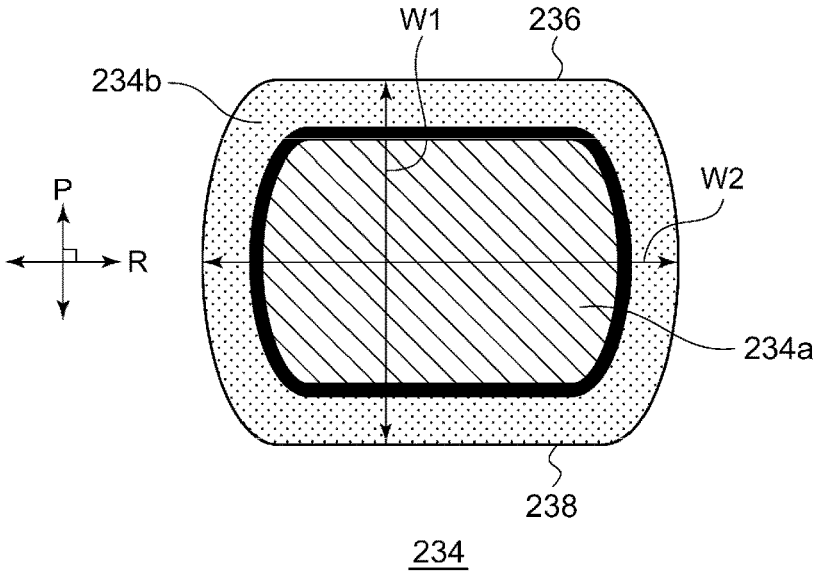
FIG. 10 is a cross sectional view of a wire member of a wire mesh according to an alternative embodiment of the present invention.

The cross section of the wire member 34 according to the embodiments is described above as being isotropic, i.e., circular, but the description is non-limiting as to the shape of the cross section. FIG. 10 is a cross sectional view of a metallic wire member 234 according to an alternative embodiment of the present invention. The wire member 234 includes a base member 234*a*, and a zinc based metal layer 234*b* covering the base member 234*a*. Like the base member 34*a* shown in FIG. 4, the base member 234*a* is formed of a copper based or iron based wire member. The width W1 of the cross section of the wire member 234 in the lamination direction P is smaller than the width W2 in a direction that intersects the lamination direction P within the cross section (e.g., the direction R perpendicular to the lamination direction P). In particular, the surface of the wire member 234 has two flat parts 236 and 238 that face each other in the lamination direction P. The wire member 234 as described above may be formed by rolling a base member having a circular cross section and coating the resultant base member with a zinc based metal.

Figure 11:
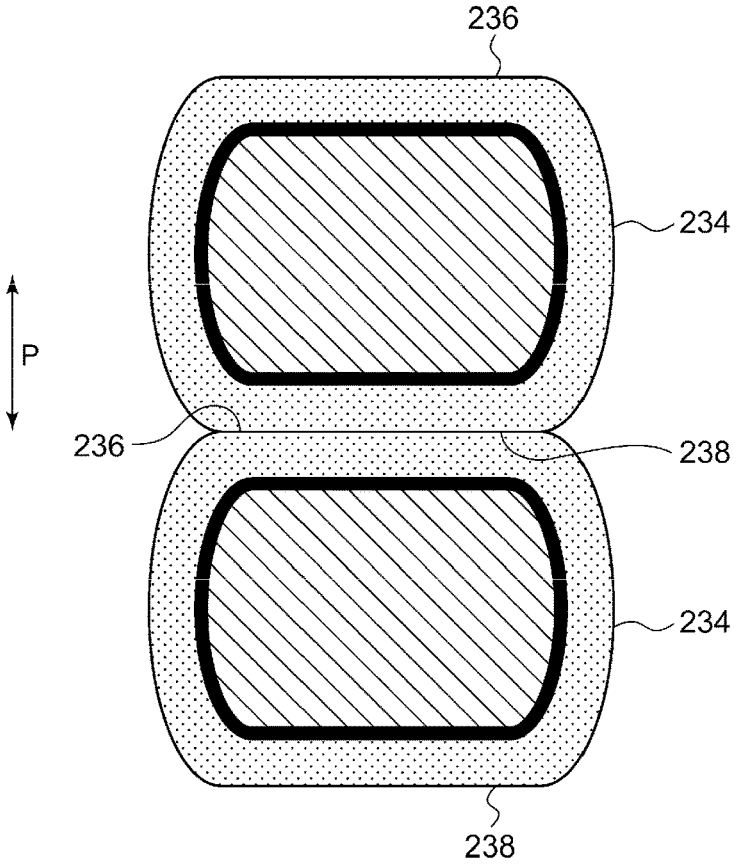
FIG. 11 is a cross sectional view of a laminate of two wire meshes having the wire member shown in FIG. 10.

FIG. 11 is a cross sectional view of a laminate of two wire meshes having the wire member 234 shown in FIG. 10. By laminating wire meshes formed of the wire member 234 in the lamination direction P, the flat part 238 on the bottom of the wire member 234 of the wire mesh above and the flat part 236 on the top of the wire member 234 of the wire mesh below are in contact with each other. The resultant area of contact is larger than when the cross section of the wire members is, for example, circular. Accordingly, contact stress occurring when the wire meshes are laminated is distributed so that a possible damage on the coating layer can be reduced.

The first stage regenerator 30 is described above as having a laminated structure built by stacking the N wire meshes 32-1-32-N in the lamination direction P, but the description is non-limiting as to the structure. For example, the first stage regenerator member may have a laminated structure built by stacking a plurality of metal plates formed with holes or a plurality of porous metal plates. In this case, the metal plate on the low temperature side may be provided with a coating layer formed by plating. The second stage regenerator 60 may similarly be provided with the metal plates having holes.

The GM refrigerator 1 is described above by way of example. Alternatively, the regenerator unit according to the embodiments may be installed in other types of refrigerators (e.g., GM type or Stirling type pulse tube refrigerator, Stirling refrigerator, Solvay refrigerator).

The two-stage regenerative refrigerator is described above by way of example. Alternatively, the regenerator unit according to the embodiments may be installed in a single stage regenerative refrigerator or a regenerative refrigerator having three or more stages. The single stage regenerative refrigerator can be configured to provide cooling temperature of 80 K or below in order to benefit from a zinc based regenerator material to improve the refrigerating capacity.

The GM refrigerator 1 and other types of regenerative refrigerators in which the regenerator according to any of the embodiments is installed may be used as cooling means or liquefying means in superconducting magnets, cryopumps, X ray detectors, infrared sensors, quantum and photon detectors, semiconductor detectors, dilution refrigerators, He3 refrigerators, adiabatic demagnetization refrigerators, helium liquefiers, cryostats, etc.

It should be understood that the invention is not limited to the above-described embodiment, but may be modified into various forms on the basis of the spirit of the invention. Additionally, the modifications are included in the scope of the invention.

Priority is claimed to Japanese Patent Application No. 2013-191537, filed on Sep. 17, 2013 and Japanese Patent Application No. 2014-094959, filed on May 2, 2014, the entire contents of which are incorporated herein by reference.

What is claimed is:

1. A regenerative refrigerator comprising:

a regenerator unit that precools a working gas; and an expander that cools the working gas by expanding the working gas precooled by the regenerator unit, wherein the regenerator unit comprises an intermediate temperature part cooled to a temperature in a range from 30 K to 80 K, an intermediate temperature regenerator member is located in the intermediate temperature part, and a low temperature part cooled to a temperature lower than the intermediate temperature part, a low temperature regenerator member is located in the low temperature part, the intermediate temperature regenerator member includes a zinc based regenerator material that is formed of zinc or an alloy containing the zinc, the zinc based regenerator material contains the zinc in an amount of at least 50 wt %, the low temperature regenerator member includes a non-magnetic regenerator material different from the zinc based regenerator material, or a magnetic regenerator material, or both, at the cooled temperature of the intermediate temperature part in the range from 30 K to 80 K, volumetric specific heat of the zinc based regenerator material is greater than volumetric specific heat of the non-magnetic or magnetic regenerator material of the low temperature regenerator member, at the cooled temperature of the low temperature part, the volumetric specific heat of the non-magnetic or magnetic regenerator material of the low temperature regenerator member is greater than the volumetric specific heat of the zinc based regenerator material.

2. The regenerative refrigerator according to claim 1, wherein the intermediate temperature part is a high temperature regenerator part of a second stage regenerator, the high temperature regenerator part of the second stage regenerator includes the zinc based regenerator material.

3. The regenerative refrigerator according to claim 2, wherein the high temperature regenerator part of the second stage regenerator includes a first block and a second block adjacent to a low temperature side of the first block, and the first block includes the zinc based regenerator material and the second block includes a non-magnetic regenerator material different from the zinc based regenerator material.

4. The regenerative refrigerator according to claim 3, wherein a relative volume of the first block relative to the total volume of the high temperature regenerator part of the second stage regenerator is in a range from 0.4 to 0.8.

5. The regenerative refrigerator according to claim 3, wherein a relative volume of the first block relative to the total volume of the high temperature regenerator part of the second stage regenerator is in a range from 0.5 to 0.7.

6. The regenerative refrigerator according to claim 2, wherein the low temperature part is a low temperature regenerator part of the second stage regenerator, the low temperature regenerator part adjacent to a low temperature side of the high temperature regenerator part, and the low temperature regenerator part of the second stage regenerator includes the magnetic regenerator material.

7. The regenerative refrigerator according to claim 1, wherein the non-magnetic regenerator material includes bismuth or tin.

8. The regenerative refrigerator according to claim 1, wherein the zinc based regenerator material does not include lead.

9. The regenerative refrigerator according to claim 1, wherein the zinc based regenerator material is formed spherically or in layers.

10. A regenerative refrigerator comprising:

a regenerator unit that precools a working gas; and an expander that cools the working gas by expanding the working gas precooled by the regenerator unit, wherein the regenerator unit comprises a first stage regenerator, wherein a low temperature regenerator part of the first stage regenerator cooled to a temperature in a range from 30 K to 80 K, the low temperature regenerator part of the first stage regenerator includes a zinc based regenerator material that is formed of zinc or an alloy containing the zinc, the zinc based regenerator material contains the zinc in an amount of at least 50 wt %, wherein a high temperature regenerator part of the first stage regenerator cooled to a temperature higher than the low temperature regenerator part of the first stage regenerator, the high temperature regenerator part of the first stage regenerator includes a different regenerator material from the zinc based regenerator material, at the cooled temperature of the low temperature regenerator part of the first stage regenerator in the range from 30 K to 80 K, volumetric specific heat of the zinc based regenerator material is greater than volumetric specific heat of the different regenerator material of the high temperature regenerator part of the first stage regenerator, at the cooled temperature of the high temperature regenerator part of the first stage regenerator, the volumetric specific heat of the different regenerator material of the high temperature regenerator part of the first stage regenerator is greater than the volumetric specific heat of the zinc based regenerator material.

11. The regenerative refrigerator according to claim 10, wherein the high temperature regenerator part of the first stage regenerator includes a different regenerator material from the zinc based regenerator material.

12. The regenerative refrigerator according to claim 10, wherein the zinc based regenerator material is formed spherically or in layers.

13. The regenerative refrigerator according to claim 12, wherein the zinc based regenerator material includes a layer of zinc or the alloy containing zinc coating a base member.

* * * * *